US008646116B2

(12) United States Patent
Crye et al.

(10) Patent No.: US 8,646,116 B2
(45) Date of Patent: Feb. 11, 2014

(54) BALLISTIC RESISTANT GROIN PROTECTOR

(75) Inventors: Caleb Clark Crye, Brooklyn, NY (US); John Bradford Thomas, Brooklyn, NY (US); Matthew Aaron Johnson, Milford, PA (US); Ali Razzaghi, New York, NY (US)

(73) Assignee: Lineweight LLC, Brooklyn, NY (US)

( * ) Notice: Subject to any disclaimer, the term of this patent is extended or adjusted under 35 U.S.C. 154(b) by 10 days.

(21) Appl. No.: 13/245,192

(22) Filed: Sep. 26, 2011

(65) Prior Publication Data

US 2013/0074251 A1 Mar. 28, 2013

(51) Int. Cl.
*A41D 27/26* (2006.01)

(52) U.S. Cl.
USPC ..... 2/466; 2/2.5; 89/36.05

(58) Field of Classification Search
USPC ..... 2/463–466, 459, 455, 2.5, 102, 457, 2/406, 210, 215, 401, 456, 458, 23, 405, 2/408
See application file for complete search history.

(56) References Cited

U.S. PATENT DOCUMENTS

| | | | | | |
|---|---|---|---|---|---|
| 1,720,439 | A * | 7/1929 | Richardson | 2/466 |
| 3,550,590 | A * | 12/1970 | Keilman | 602/73 |
| 4,622,962 | A * | 11/1986 | Kauffman | 602/70 |
| 4,922,899 | A * | 5/1990 | Graff et al. | 602/72 |
| 5,295,267 | A * | 3/1994 | Galindo | 2/466 |
| 5,465,424 | A * | 11/1995 | Cudney et al. | 2/462 |
| 5,500,951 | A * | 3/1996 | Marchello | 2/455 |
| 5,966,747 | A * | 10/1999 | Crupi et al. | 2/466 |
| 6,345,396 | B1 * | 2/2002 | Schuler | 2/467 |
| 6,745,394 | B1 * | 6/2004 | Rutherford | 2/2.5 |
| 7,266,850 | B1 * | 9/2007 | Strum et al. | 2/2.5 |
| 2005/0177931 | A1 * | 8/2005 | Tsujimoto | 2/466 |
| 2007/0016996 | A1 * | 1/2007 | Seitzinger et al. | 2/2.5 |
| 2008/0134419 | A1 * | 6/2008 | Kalaam et al. | 2/463 |
| 2010/0154095 | A1 * | 6/2010 | Sides | 2/102 |
| 2010/0229273 | A1 * | 9/2010 | Crye | 2/2.5 |
| 2010/0275349 | A1 * | 11/2010 | Wilson, II | 2/466 |
| 2011/0072545 | A1 * | 3/2011 | Bennett | 2/2.5 |

* cited by examiner

*Primary Examiner* — Danny Worrell
*Assistant Examiner* — Khaled Annis
(74) *Attorney, Agent, or Firm* — Warner Norcross & Judd LLP

(57) ABSTRACT

A ballistic resistant groin protector is provided. The groin protector includes a groin panel and a deployable groin wrap. The groin panel can be suspended from clothing or equipment to protect a wearer's anterior pelvic region from ballistic impact. The groin wrap is moveable from a stowed position adjacent the anterior pelvic region to a deployed position between the wearer's legs and adjacent a posterior pelvic region. One or more fasteners secure the groin wrap to the wearer's clothing or equipment to maintain the groin wrap in the deployed position. Optional left and right femoral protective portions extend downwardly from the groin wrap to protect the wearer's medial thigh regions against ballistic injury in the deployed position.

19 Claims, 5 Drawing Sheets

BALLISTIC RESISTANT GROIN PROTECTOR

BACKGROUND OF THE INVENTION

The present invention relates to personal body armor, and more particularly to personal body armor for the groin and pelvic regions.

Numerous types of personal body armor exist for protection against bullets, shrapnel and other projectiles. For example, a wide range of armored vests are known to provide ballistic protection to the torso region. While widely accepted, armored vests typically leave other areas of the body exposed to injury, including for example the groin and pelvic regions. Especially in instances where the nearby femoral arteries are injured, such injuries can be life threatening and in many instances fatal.

Ballistic resistant lap panels have been developed in an effort to supplement the protection afforded by armored vests. Lap panels include pliable ballistic panels and/or rigid ballistic plates that are suspended from the wearer's waist to hang over the anterior pelvic region and groin area. Such lap panels are typically loosely coupled to the wearer's belt and rest against the wearer's anterior pelvic region when in the standing and sitting positions. Despite their growing acceptance, lap panels provide protection against predominantly forward impacts only. In addition, lap panels typically include an apex near the groin region, providing only minimal protection to the groin and femoral arteries.

SUMMARY OF THE INVENTION

A ballistic resistant groin protector including a groin panel and a deployable groin wrap is provided. The groin panel is adapted to be suspended from clothing or equipment to protect a wearer's anterior groin region. The groin wrap is moveable from a stowed position adjacent or within the groin panel to a deployed position between the wearer's legs and adjacent the wearer's posterior. The groin wrap includes one or more fasteners attachable to clothing or equipment when in the deployed position.

In one embodiment, the groin wrap is hingedly coupled to the groin panel. The groin wrap folds downwardly to deploy from a position between the groin panel and the wearer's anterior groin region. The groin wrap includes a pliable ballistic material adapted to conform to the contours of a wearer's body. Once deployed, the groin wrap extends rearwardly between the wearer's legs and upwardly against the wearer's posterior pelvic region. Left and right femoral protective portions extend downwardly from the groin wrap to protect wearer's femoral arteries against ballistic injury.

In another embodiment, the groin panel includes a pocket to receive the groin wrap in the stowed position. The pocket includes a reclosable opening along a portion thereof for receiving and storing the groin wrap in a folded condition. The groin wrap includes convex lateral edges that taper proximate the wearer's groin region to provide freedom of movement to the wearer. The groin wrap can include a suspender system with quick release fasteners that are attachable to clothing or equipment.

Embodiments of the invention can therefore provide added protection against ballistic injury to the wearer's groin region while selectively providing added protection to the wearer's posterior and femoral regions. When additional protection is no longer desired, the groin wrap can be quickly stowed within or adjacent the forward facing groin panel. In the stowed position, the groin wrap provides additional protection against ballistic projectiles from an area forward of the wearer.

These and other advantages and features of the invention will be more fully understood and appreciated by reference to the description of the current embodiments and the drawings.

DESCRIPTION OF THE CURRENT EMBODIMENTS

Figure 1:
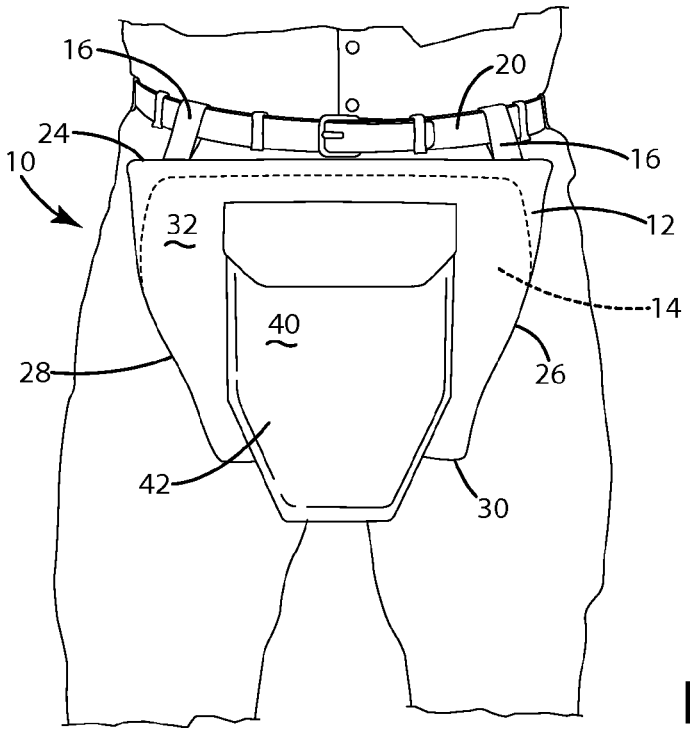
FIG. 1 is a front view of a ballistic resistant groin protector in accordance with an embodiment of the present invention.
Figure 2:
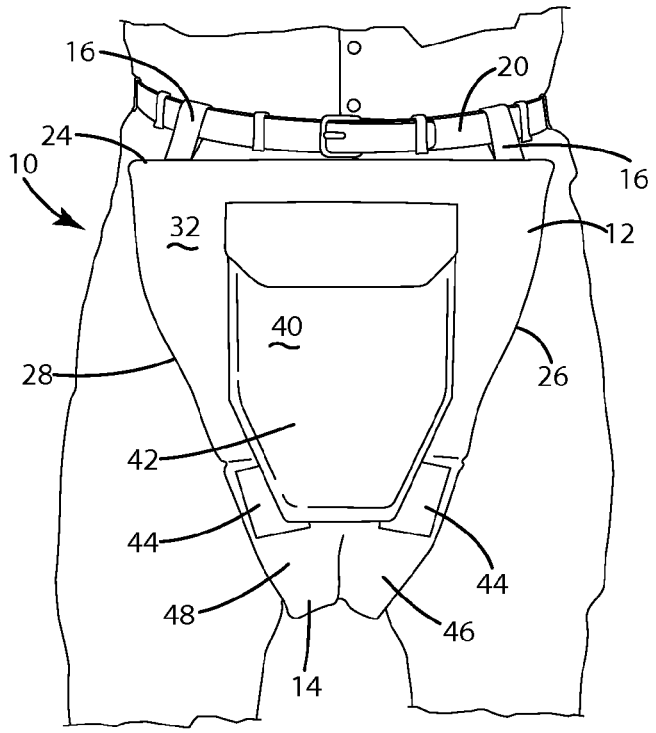
FIG. 2 is a front view of the ballistic resistant groin protector of FIG. 1 illustrating a deployed groin wrap.
Figure 3:
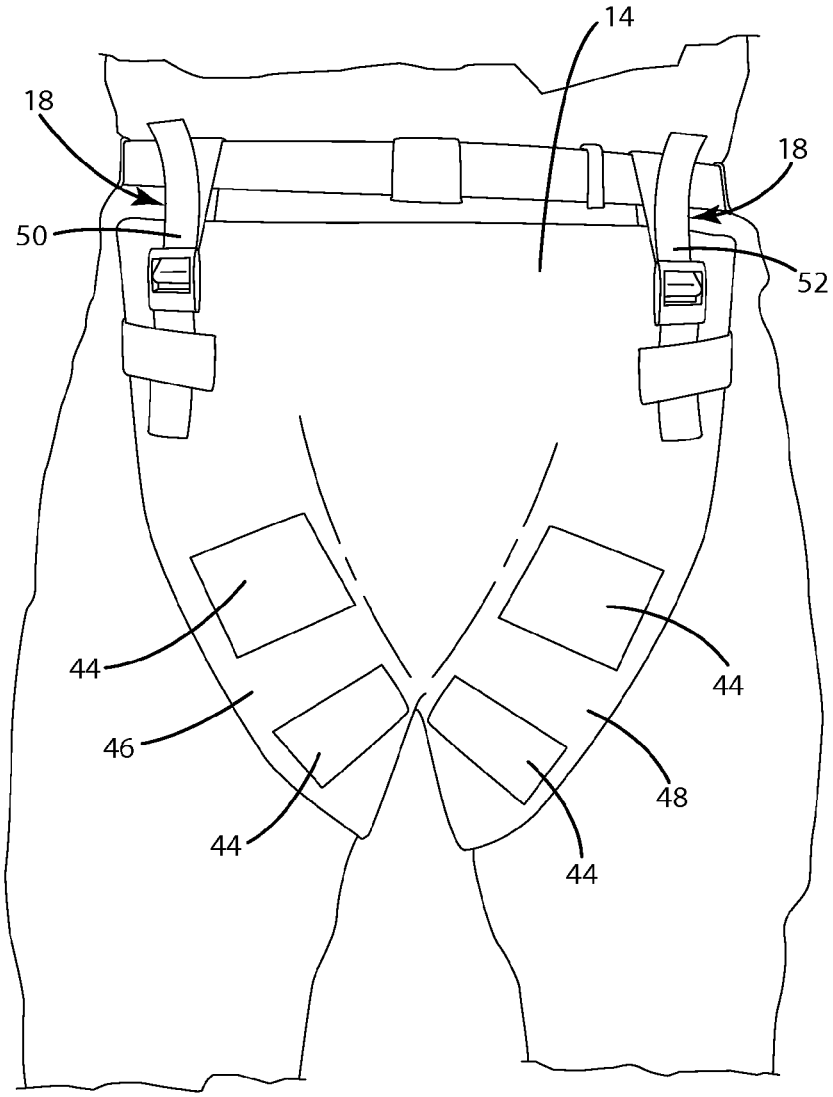
FIG. 3 is a rear view of the ballistic resistant groin protector of FIG. 1 illustrating a deployed groin wrap.
Figure 4:
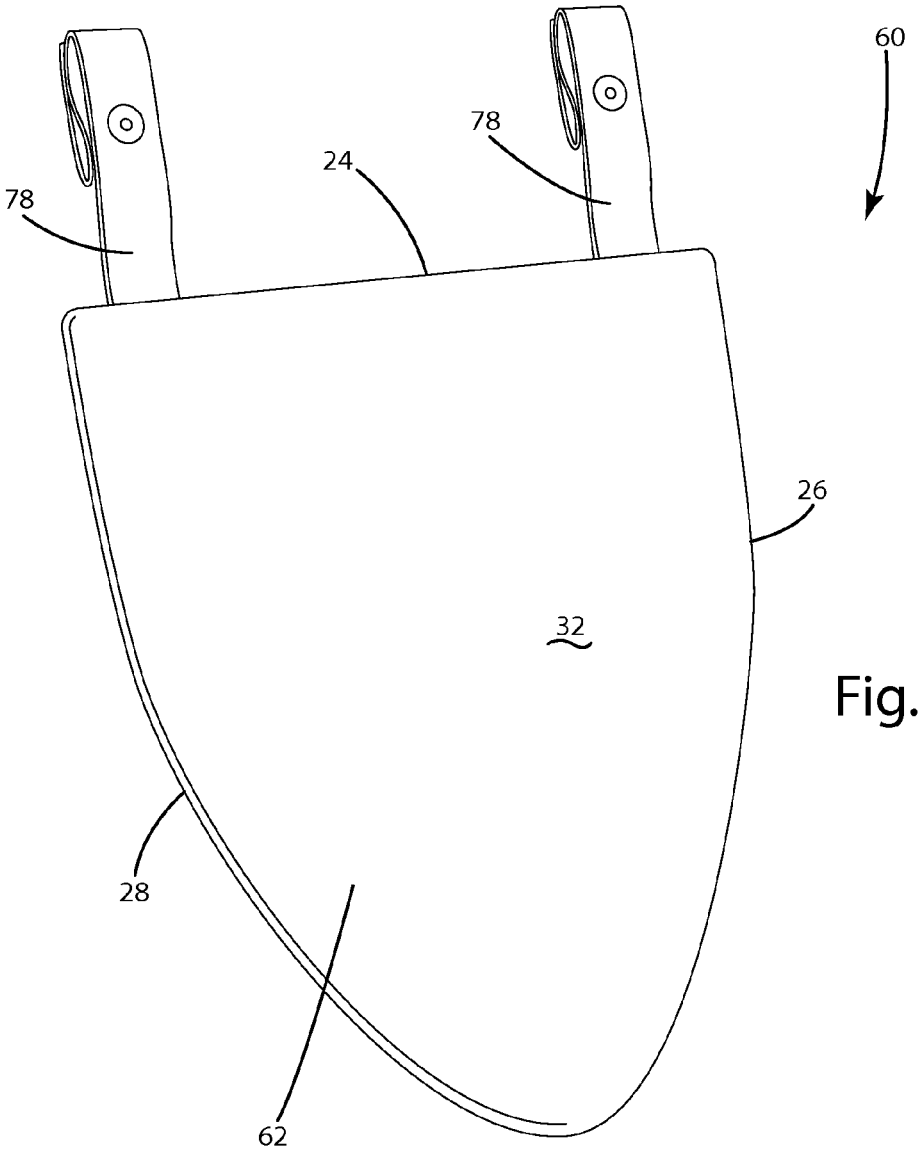
FIG. 4 is a front view of a ballistic resistant groin protector in accordance with a second embodiment of the present invention.

An improved groin protector in accordance with a first embodiment is illustrated in FIGS. 1-3 and generally designated 10. The groin protector 10 includes a groin panel 12 and a groin wrap 14. The groin panel 12, sometimes referred to as a lap panel, is generally suspended from a wearer's clothing or equipment to protect a wearer's groin region. The groin wrap 14 is moveable from a stowed position adjacent the groin panel 12 to a deployed position to protect the wearer's groin region and posterior region. One or more fasteners 16, 18 removably attach the groin panel 12 and groin wrap 14 to the wearer's clothing or equipment, for example the wearer's belt 20 or an armored vest 22.

The groin panel 12 can be generally trapezoidal to provide protection against ballistic threats while not unduly restricting movement of the wearer. As shown in FIG. 1 for example, the groin panel 12 includes an upper periphery 24 generally parallel to the wearer's belt 20, and left and right lateral edges 26, 28 that converge at a lower periphery 30 at or below the wearer's groin region. The groin panel 12 can therefore be shaped to overlay all or at least a portion of a wearer's anterior pelvic region. The groin panel 12 can include multiple layers of ballistic resistant fabric to form a unitary panel enclosed within an outer fabric sleeve. A front surface 32 spaced apart from a rear surface 34 can define a generally uniform cross-section therebetween.

As noted above, the groin panel 12 includes one or more fasteners 16, 18 to removably attach the groin panel 12 to the wearer's clothing or equipment. For example, the groin panel 12 can include left and right looped members 16 for receipt of the wearer's belt 20 therethrough. The fasteners 16 can also releasably couple to an armored vest 22 worn by a user. For example, the fasteners 16 can include a clip for attachment to a transverse nylon web 38 on the exterior of the armored vest 22. While only two fasteners 16 are shown, greater or fewer number of fasteners can be utilized to loosely suspend the groin plate 12 over the anterior pelvic region of the wearer. When used in combination with a belt 20, the groin protector 10 and belt 20 cooperate to define left and right leg openings.

As shown in FIGS. 1-2, the groin panel 12 can optionally include a reclosable pocket 40 on the front surface 30 for receipt of a ballistic panel 42, for example a metal or ceramic plate. In some embodiments the ballistic panel 42 can extend below the lower periphery 30 to provided additional protection to the groin region, while in other embodiments the ballistic panel 42 is positioned in the region between the upper and lower peripheries 24, 30. In addition, the groin wrap 14 is hingedly coupled to the groin panel 12 along the groin panel lower periphery 30. In the stowed position as shown in FIG. 1, the groin wrap 14 is folded upwardly against the groin panel rear surface 34 and secured thereto using one or more hook and loop connectors, snaps or other suitable fasteners 44. Optionally, the groin wrap 14 is folded along multiple lateral creases in an accordion-like manner to fit behind the groin panel 12. Further optionally, only a portion of the groin wrap 14 is concealed behind the groin panel 12 in the stowed position.

The groin wrap 14 can include a pliable ballistic material adapted to conform to the contours of the wearer's groin region and posterior region. Once deployed from the stowed position, the groin wrap 14 can extend rearwardly between the wearer's legs adjacent the groin region and upwardly adjacent the wearer's posterior, or more specifically, the wearer's posterior pelvic region. The groin wrap 14 tapers to an apex proximate the wearer's groin region, and left and right femoral protective portions 46, 48 extend downwardly from the groin wrap 14 to protect the wearer's femoral arteries against ballistic injury. The left and right femoral protective portions 46, 48 can each include multiple layers of ballistic fabric which form a single flexible element enclosed within a durable nylon sleeve. The femoral protective portions 46, 48 are hingedly coupled to the groin wrap 14 to provide a full range of motion to the wearer's legs. In particular, the femoral protective portions 46, 48 are urged into registration against the wearer's inner thighs to provide protection in the standing, walking, running, and sitting positions.

As shown in FIG. 3, left and right looped members 50, 52 removably attach the groin panel 14 to the wearer's clothing or equipment. While only two looped members are shown, greater or fewer number of looped members (or other fasteners) can be utilized to maintain the groin wrap 14 adjacent over the posterior pelvic region of the wearer. In other embodiments the groin wrap 14 can include a clip for attachment to a transverse nylon web 38 on the exterior of an armored vest 22. When the wearer desires to return the groin wrap 14 to the stowed position, the looped members 50, 52 are released from the wearer's belt 20 and the groin wrap 14 is guided forward through the wearer's legs to a position behind or adjacent the groin panel 12. In this stowed position, the groin wrap 14 provides added protection against ballistic projectiles from an area forward of the wearer.

Figure 6:
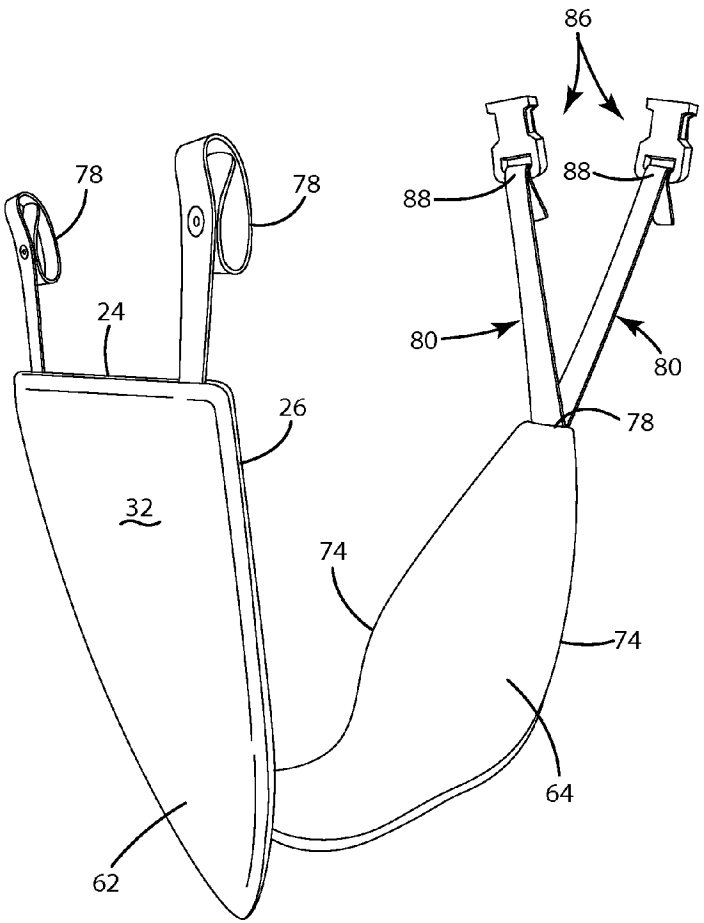
FIG. 6 is a side perspective view of the ballistic resistant groin protector of FIG. 4 illustrating a fully deployed groin wrap.
Figure 5:
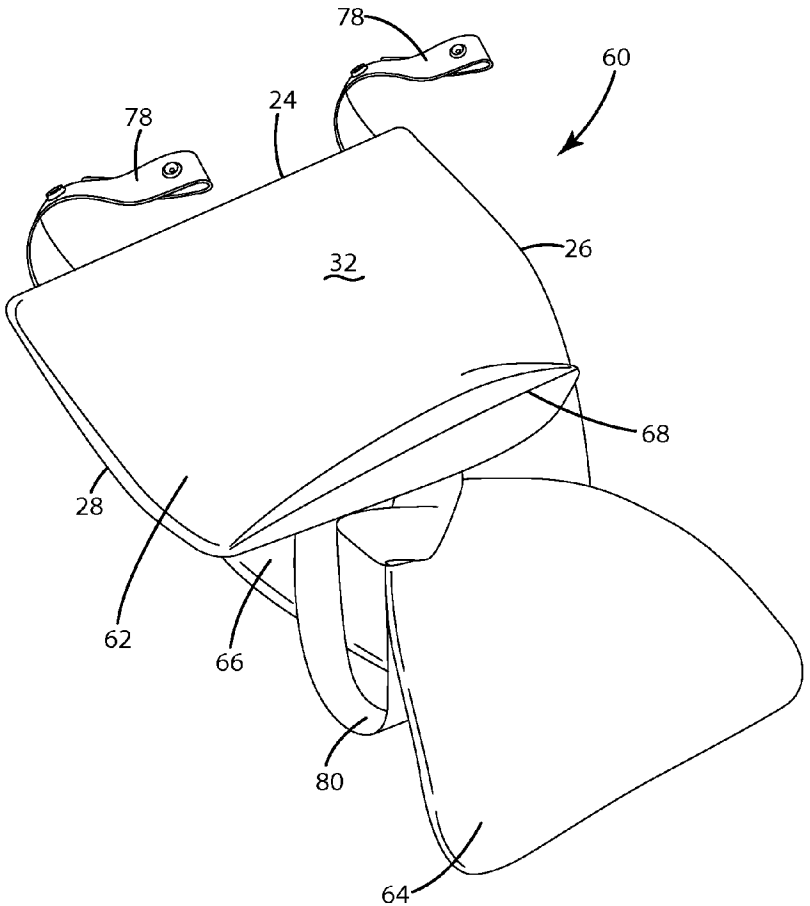
FIG. 5 is a front view of the ballistic resistant groin protector of FIG. 4 illustrating a partially deployed groin wrap.
Figure 8:
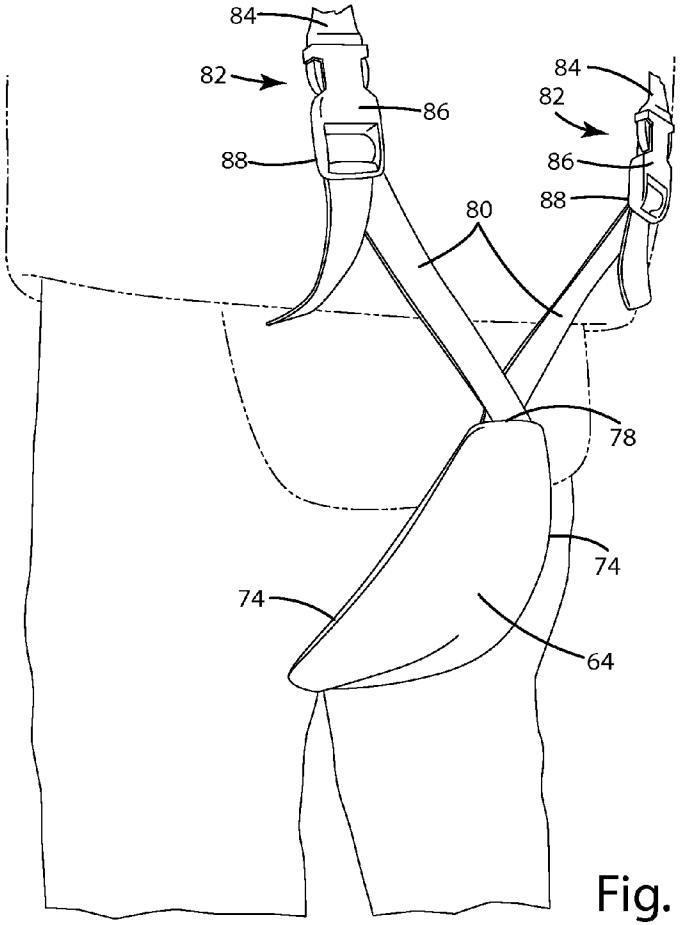
FIG. 8 is a rear perspective view of the ballistic resistant groin protector of FIG. 4 worn in combination with a load-bearing vest with the groin wrap in the deployed position.
Figure 7:
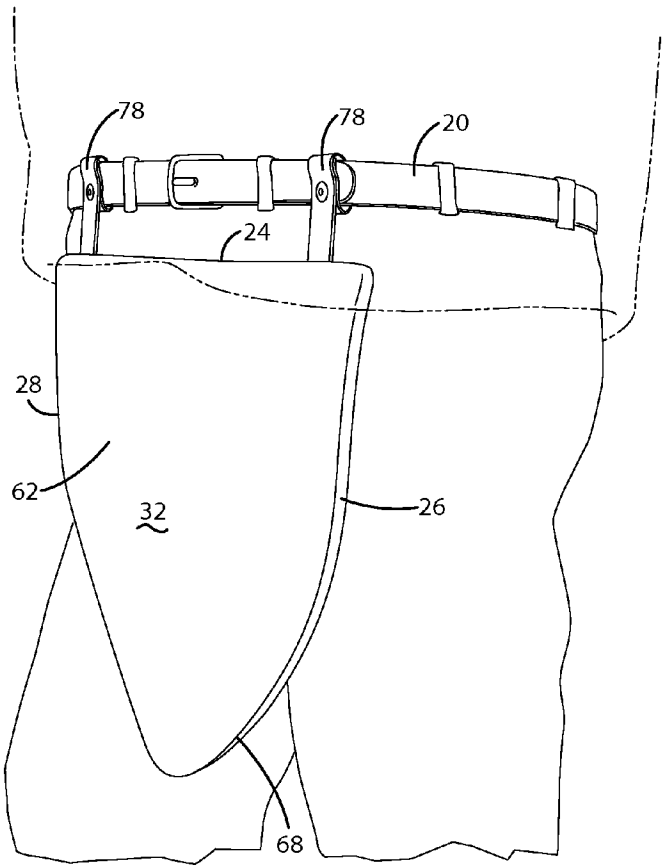
FIG. 7 is a front perspective view of the ballistic resistant groin protector of FIG. 4 worn in combination with a load-bearing vest with the groin wrap in the stowed position.

Referring now to FIGS. 4-8, a groin protector in accordance with a second embodiment is illustrated and generally designated 60. The groin protector 60 is similar in structure and function to the groin protector 10 discussed above in connection with FIGS. 1-3, and includes a groin wrap 64 that is stowable within a pocket 66 in a groin panel 62. In particular, the groin wrap 64 may be folded against itself to fit within the pocket 66. The pocket 66 can include a reclosable opening 68 extending along the bottom portion of the groin panel 62. The reclosable opening 68 includes one or more fasteners 70, for example snap connectors, hook and loop connectors or zipper connectors, to maintain the pocket closed in the stowed configuration. In this configuration, the groin wrap 64 provides added protection to the groin and the anterior pelvic region against projectiles and other objects. To deploy the groin wrap 64, the wearer opens the reclosable opening 68 as shown in FIG. 5. The groin wrap 64, and a rearward facing portion of the groin panel 62, fold rearwardly as shown in FIG. 6 to generally conform to the contour of the wearer's groin region. The groin wrap 64 includes convex lateral edges 74 that taper proximate the wearer's groin region and again at an upper periphery 76 to provide a ballistic-resistant seat panel.

As perhaps best shown in FIG. 6, the groin panel 62 further includes looped connectors 78 for supporting the groin panel 62 from the wearer's belt 20. The groin wrap 64 includes an adjustable suspender system 80 with quick-release connectors 82 that are attachable to clothing or equipment. For example, the quick-release connectors 82 can include a male end 84 anchored to webbing on a load-bearing vest 22 and a female end 86 coupled to the groin wrap 64. The female end 86 can also include an adjustable buckle 88 to lengthen or shorten the suspender system 80 as desired. When it is desirable to stow the groin wrap 64, the wearer can disengage the quick-release connectors 82, which are typically positioned near the small of the wearer's back. The groin wrap 64 can be collected from below the groin panel 62 and folded against itself before being inserted into the reclosable groin panel pocket 66. The pocket 66 can be closed to prevent the groin wrap 64 from inadvertently moving from the stowed position. If frontal groin protection is no longer desired, the wearer can unfasten the looped connectors 78 and store the groin protector 60 for later use.

As used above, directional terminology, including upper/lower, radial/longitudinal, vertical/horizontal, inward/outward and inner/outer, is not intended to limit the present invention, and is instead used for clarity when referring to the accompanying drawings. It is also understood that ordinal terminology (such as "first," "second," "third" and so on) is used merely to indicate a particular feature, so as to distinguish from another feature described by the same term or a similar term. It will be understood that the mere usage of ordinal terminology does not define a numerical limit to the number of features identified.

The above descriptions are those of the current embodiments of the invention. Various alterations and changes can be made without departing from the spirit and broader aspects of the invention as defined in the appended claims, which are to be interpreted in accordance with the principles of patent law including the doctrine of equivalents. Any reference to elements in the singular, for example, using the articles "a," "an," "the," or "said," is not to be construed as limiting the element to the singular.

The invention claimed is:

1. A groin protector comprising:

a groin panel adapted to protect an anterior pelvic region of a wearer, the groin panel including a front surface and a rear surface; and a groin wrap hingedly coupled to the groin panel along a fold line, wherein the groin wrap is moveable about the fold line from a stowed position to a deployed position when the groin protector is worn, wherein the groin wrap is positioned between the rear surface of the groin panel and the anterior pelvic region of the wearer in the stowed position to protect the wearer against anterior ballistic impacts, and wherein the groin wrap extends between the legs of the wearer and adjacent a posterior pelvic region in the deployed position to protect the wearer against posterior ballistic impacts, wherein the groin protector further includes a means for securing the groin wrap to the groin panel when the groin wrap is stowed adjacent the anterior pelvic region of the wearer when said groin protector is worn.

2. The groin protector of claim 1 wherein the groin wrap includes left and right femoral protective portions.

3. The groin protector of claim 1 wherein the groin panel includes an upper periphery attachable to a belt when worn by a wearer.

4. The groin protector of claim 1 wherein the groin wrap includes a plurality of fasteners removably attachable to one of a belt and a load bearing vest.

5. The groin protector of claim 1 wherein the groin panel and the groin wrap each include a ballistic resistant material.

6. A body armor system comprising:

a ballistic member being conformable to a user's groin region to define a front portion spaced apart from a rear portion when worn by a user, the front portion including a front surface and a rear surface, the rear portion being hingedly coupled to the front portion along a fold line, wherein the rear portion is stowable between the rear surface of the front portion and the user's groin region while being worn by the user to protect the user's groin region against anterior ballistic impacts; and a means for securing the rear portion to the front portion when the rear portion is stowed adjacent the front portion where the body armor is worn.

7. The body armor system of claim 6 wherein the front portion includes an upper periphery attachable to a belt when worn by the user.

8. The body armor system of claim 6 wherein the rear portion includes an upper periphery attachable to a belt when worn by the user.

9. The body armor system of claim 6 further including left and right femoral protective portions extending laterally downward of the ballistic member.

10. The body armor system of claim 6 wherein the rear portion includes a plurality of fasteners removably attachable to a load bearing vest.

11. A tactical garment for a wearer's pelvic region, comprising:

a front ballistic resistant portion including a forward face and a rearward face; and a rear ballistic resistant portion deployably coupled to the front ballistic resistant portion and moveable from a stowed position to a deployed position when the tactical garment is worn, wherein the rear ballistic resistant portion is stowable between the rearward face of the front ballistic resistant portion and the wearer's anterior pelvic region in the stowed position to protect the wearer against anterior ballistic impacts, and wherein the rear ballistic resistant portion extends between the legs of the wearer and adjacent the wearer's posterior pelvic region in the deployed position to protect the wearer against posterior ballistic impacts, wherein the tactical garment further includes a means for securing the rear ballistic resistant portion to the front ballistic resistant portion when the rear ballistic resistant portion is in the stowed position when the tactical garment is worn.

12. The tactical garment of claim 11 wherein the rear ballistic resistant portion is folded against the front ballistic resistant portion in the stowed position.

13. The tactical garment of claim 11 wherein the rear ballistic resistant portion includes left and right femoral protective portions.

14. The tactical garment of claim 13 wherein the left and right femoral protective portions are shaped to conform to medial thigh regions of the wearer.

15. The tactical garment of claim 11 wherein the front ballistic resistant portion includes an upper periphery removably attachable to a belt when worn by the wearer.

16. The tactical garment of claim 11 wherein the rear ballistic resistant portion includes a plurality of fasteners removably attachable to one of a belt and a load bearing vest.

17. The tactical garment of claim 11 wherein the front ballistic resistant portion includes a reclosable pocket for receipt of a ballistic panel therein.

18. The groin protector of claim 1 wherein the groin panel includes a reclosable pocket for receipt of a ballistic panel therein.

19. The body armor system of claim 6 wherein the front portion includes a reclosable pocket for receipt of a ballistic panel therein.

* * * * *

UNITED STATES PATENT AND TRADEMARK OFFICE

CERTIFICATE OF CORRECTION

PATENT NO. : 8,646,116 B2
APPLICATION NO. : 13/245192
DATED : February 11, 2014
INVENTOR(S) : Caleb Clark Crye et al.

It is certified that error appears in the above-identified patent and that said Letters Patent is hereby corrected as shown below:

In the Claims:

Column 5, Line 31:

"tion where the body armor is worn."

should be

-- tion when the body armor is worn. --

Signed and Sealed this
Twenty-ninth Day of April, 2014

Michelle K. Lee

Michelle K. Lee
*Deputy Director of the United States Patent and Trademark Office*